US006297178B1

(12) United States Patent
Berbner et al.

(10) Patent No.: US 6,297,178 B1
(45) Date of Patent: Oct. 2, 2001

(54) FLAMEPROOF FABRICS BASED ON MELAMINE RESIN FIBRES

(75) Inventors: Heinz Berbner, Mörlenbach; Ägidius Eckel, Niederkirchen; Hans-Dieter Eichhorn, Weisenheim am Berg; Karl Ott, Plankstadt, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/171,825

(22) PCT Filed: Apr. 30, 1997

(86) PCT No.: PCT/EP97/02225

§ 371 Date: Oct. 27, 1998

§ 102(e) Date: Oct. 27, 1998

(87) PCT Pub. No.: WO97/42365

PCT Pub. Date: Nov. 13, 1997

(30) Foreign Application Priority Data

May 2, 1997 (DE) ..... 196 17 634

(51) Int. Cl.[7] ..... D03D 15/12
(52) U.S. Cl. ..... 442/302; 442/301; 428/921
(58) Field of Search ..... 428/921; 442/301–302

(56) References Cited

U.S. PATENT DOCUMENTS

| | | | | |
|---|---|---|---|---|
| 4,014,829 | | 3/1977 | Baird et al. | 260/17 |
| 4,088,620 | | 5/1978 | Nihongi et al. | 260/29 |
| 4,201,825 | | 5/1980 | Ebneth | 428/263 |
| 4,794,037 | * | 12/1988 | Hosoda et al. | 428/264 |
| 4,996,289 | | 2/1991 | Berbner et al. | 528/230 |
| 5,084,488 | | 1/1992 | Weiser et al. | 521/187 |
| 5,162,487 | | 11/1992 | Weiser et al. | 528/254 |
| 5,496,625 | * | 3/1996 | Lilani | 428/229 |
| 5,560,961 | | 10/1996 | Adel et al. | 427/304 |
| 5,560,990 | | 10/1996 | Ilg et al. | 428/362 |
| 6,004,892 | * | 12/1999 | Guenther et al. | 442/229 |

FOREIGN PATENT DOCUMENTS

| | | |
|---|---|---|
| 41152/96 | 6/1996 | (AU) . |
| 2222206 | 1/1997 | (CA) . |
| 3810597 | 10/1988 | (DE) . |
| 19523081 | 1/1997 | (DE) . |
| 093965 | 5/1982 | (EP) . |
| 221330 | 9/1985 | (EP) . |
| 96/15207 | 5/1996 | (WO) . |

* cited by examiner

*Primary Examiner*—Terrel Morris
*Assistant Examiner*—Norca L. Torres
(74) *Attorney, Agent, or Firm*—Keil & Weinkauf

(57) ABSTRACT

The present invention relates to flameproof fabrics based on melarnine resin fibres, fireproof blankets and clothing made therewith and their use for extinguishing fires and protecting people and objects from fire, combustion products and/or extinguishing agents.

10 Claims, No Drawings

FLAMEPROOF FABRICS BASED ON MELAMINE RESIN FIBRES

The present invention relates to flame-proof fabrics based on melamine resin fibers, fire-safety blankets and clothing manufactured therefrom and their use for extinguishing fires and protecting persons and objects from fire, combustion products and/or extinguishants.

Conventional fire-safety blankets, or just "fire blankets", are generally used for fighting minor fires by extinguishing the flames through suffocation.

Known fire-safety blankets and fire-safety clothing frequently consist of glass fiber fabrics. These fire-safety blankets have the disadvantage of being very brittle and of melting easily. More particularly, there is consequently a danger that fire-safety blankets made of this material will burn through in the event of a fire. Furthermore, fire-safety blankets based on aramid fibers are known, but such blankets are still very costly. Furthermore, the fire-retarding effect of aramid-based fabrics is still unsatisfactory. In addition, fire-safety clothing in these fabrics has only moderate wear comfort.

However, there is also a need for fire-safety blankets which are not primarily used as fire-extinguishing blankets, but which should be suitable in particular for protecting persons or objects from fire, heat, combustion products, such as soot, or extinguishants.

Such safety blankets would be particularly useful for example in churches and museums, which frequently house a multiplicity of irreplaceable works of art which are only badly protected against fire and, in the event of a fire, against the direct consequences of a fire, such as heat and soot, and also against the consequences of extinguishing measures.

Prior art fire-safety blankets are unsuitable for this specific purpose, since they are either too heavy, too stiff or too permeable to microparticles or liquids.

It is an object of the present invention to provide a flame-proof fabric for fire-safety blankets or clothing, which offers effective protection from fire, extinguishants and/or combustion products, i.e. is heat-, water-, soil- and/or oil-resistant.

We have found that this object is achieved by a flame-proof fabric comprising, based on the total weight of the fabric, a) from 4.9 to 95% by weight of melamine resin fibers, b) from 0 to 90.1% by weight of flame-proof fibers selected from the group consisting of aramid fibers, carbon fibers, glass fibers, flame-proof wool and flame-proof viscose, and c) from 0 to 20% by weight of fillers, further comprising d) from 4.9 to 95% by weight of normal-flammable fibers and/or e) from 0.1 to 20% by weight of at least one heat-, oil-, soil- and/or moisture-resistant finish.

The present invention also provides fire-safety blankets and clothing which can be manufactured in the flame-proof fabric of the invention.

The invention further provides for the use of such fire-safety blankets for protecting objects from fire, heat, combustion products and/or extinguishants and also for the use for extinguishing fires.

Flame-retardant fabrics comprising the abovementioned constituents a), b), c) and d) can be conventionally woven from yarns or produced in the form of nonwovens from the fibers or fiber blends (see Ullmann's Enzyklopädie der Technischen Chemie, 4th edition, Vol. 23, "Textiltechnik").

Thereafter component e) is applied. It is also possible to finish the fibers a), b) and d), or the yarns spun therefrom, with component e), and then to further process the fibers or yarns to the fabrics of this invention.

In addition, however, the fabrics of this invention may further include from about 4.9 to 95% by weight, preferably from about 5 to 50% by weight, , in particular from about 10 to 45% by weight, of normal-flammable fabric, for example wool, cotton, polyamide fibers, polyester fibers and viscose. But the amount which is used of these fibers must not adversely affect the flame retardancy of the fabric.

The addition of normal-flammable fabric offers a number of advantages. If, for example, cotton or other comparable fibers are used as further component, it becomes possible to produce fabrics having an enhanced water absorption capacity, whereby it is possible to obtain improved protection from moisture, for example from water used in extinguishing the fire. Further, the addition of normal-flammable fibers can improve the wear comfort of fabrics. This is of particular advantage when protective clothing is to be manufactured from the fabrics. Also, the addition of normal-flammable fibers leads to a considerable reduction in the cost of flame-proof fabrics based on melamine resin fibers.

Instead of the normal-flammable fibers or in combination therewith, the fabrics of this invention may include from 0.1 to 20% by weight, preferably from about 0.5 to 10% by weight, of a heat-, oil-, soil- and/or moisture-resistant finish. The fabric can be impregnated or coated with the finish.

Examples of finishes which are suitable for use in conjunction with the present invention are one- or two-sidedly applied coats of metal, for example aluminum. Such metal coats, which are usually applied in a thickness of for example 5–200 $\mu$m, preferably 10–100 $\mu$m, so that the flexibility of the fabric is not adversely affected, protect from fire, the action of heat, especially radiant heat, soot and extinguishants, for example water and foams or powders. In line with the provisional European standard pr EN 1486, metallized fabrics are suitable for manufacturing protective suits for heavy duty fire and heat protection. The fabric is generally metallized by vacuum vapor deposition (see Ullmann's Enzyklopädie der Technischen Chemie, 3rd edition, Vol. 15, p. 276 and references cited therein). It is also possible to adhere thin metal foils to the fabric. Such metal foils consist in general of a polymeric support film coated with a thin film of metal. They preferably comprise a polymeric support based on polyester. The metal foils can be applied on one or preferably both sides of the fabric of this invention according to TL 8415–0203 (TL=technical supply specification of the German defense forces), for example by means of an adhesive or by hot calendering. Such foils are used for the coating of fabrics by various manufacturers (e.g. Gentex Corp., Carbondale PA, USA; C.F.Ploucquet GmbH & Co, D-89522 Heidenheim; Darmstädter GmbH, D-46485 Wesel).

It is also possible to produce the fabrics of this invention from metallized yarns or fibers. The yarns are preferably coated with aluminum in layer thicknesses within the range from 10–100 $\mu$m, while the fibers have metal coatings from 0.01 to 1 $\mu$m. Such yarns or fibers are producible for example in line with the processes described in DE-B 27 43 768, DE-A 38 10 597 or EP-A 528 192.

Further examples of finishes suitable for use in conjunction with the present invention are water-repellent hydrophobic layers applied on one or both sides of the fabric. Such layers consist preferably of polyurethane-including materials and/or polytetrafluoroethylene-including materials. Such coatings are already known for improving the weather protection of textiles (see Ullmann's Enzyklopädie der Technischen Chemie, 5th edition, Vol. A26, p. 306–312, and Lexikon fur Textilveredelung, 1955, p. 211 et seq.). These coatings can be formed in such a way that water vapor can diffuse through the layer, but liquid water or similar fire extinguishant products and combustion products can not pass through to any significant extent, if at all. These coatings are generally adhered or calendered onto the fabric as polymer films.

Further measures for improving the protection afforded by fire-safety blankets are finishing the fibers or the fabric with water-, oil- and/or soil-repellent compounds (hydrophobic or oleophobic finishing). Such compounds are known for use as textile assistants (cf. Ullmann's Encyclopedia of Industrial Chemistry 5th Ed., Vol. A26, p. 306–312). Examples of water-repellent compounds are metal soaps, silicones, organofluorine compounds, for example salts of perfluorinated carboxylic acids, polyacrylates of perfluorinated alcohols (see EP-B-366 338 and references cited therein) or tetrafluoroethylene polymers. The last two polymers especially are also used as oleophobic, oil-repellent finishes.

The melamine resin fibers used in conjunction with this invention can be produced for example by the methods described in EP-A-93 965, DE-A-23 64 091, EP-A-221 330 or EP-A-408 947. Particularly preferred melamine resin fibers include as monomer building block (A) from 90 to 100 mol % of a mixture consisting essentially of from 30 to 100, preferably from 50 to 99, particularly preferably from 85 to 95, particularly from 88 to 93 mol % of melamine and from 0 to 70, preferably from 1 to 50, particularly preferably from 5 to 15, particularly from 7 to 12 mol % of a substituted melamine I or mixtures of substituted melamines I.

As further monomer building block (B), the particularly preferred melamine resin fibers include from 0 to 10, preferably from 0.1 to 9.5, particularly from 1 to 5 mol %, based on the total number of moles of monomer building blocks (A) and (B), of a phenol or a mixture of phenols.

The particularly preferred melamine resin fibers are customarily obtainable by reacting components (A) and (B) with formaldehyde or formaldehyde-supplying compounds in a molar ratio of melamines to formaldehyde within the range from 1:1.15 to 1:4.5, preferably from 1:1.8 to 1:3.0, and subsequent spinning.

Suitable substituted melamines of the general formula I (I)

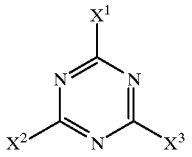

are those in which $X^1$, $X^2$ and $X^3$ are each selected from the group consisting of —$NH_2$, —$NHR^1$ and —$NR^1R^2$, although $X^1$, $X^2$ and $X^3$ must not all be —$NH_2$, and $R^1$ and $R^2$ are each selected from the group consisting of hydroxy-$C_2$–$C_{10}$-alkyl, hydroxy-$C_2$–$C_4$-alkyl-(oxa-$C_2$–$C_4$-alkyl)$_n$, where n is from 1 to 5, and amino-$C_2$–$C_{12}$-alkyl.

Hydroxy-$C_2$–$C_{10}$-alkyl is preferably hydroxy-$C_2$–$C_6$-alkyl such as 2-hydroxyethyl, 3-hydroxy-n-propyl, 2-hydroxyisopropyl, 4-hydroxy-n-butyl, 5-hydroxy-n-pentyl, 6-hydroxy-n-hexyl, 3-hydroxy-2,2-dimethylpropyl, preferably hydroxy-$C_2$–$C_4$-alkyl such as 2-hydroxyethyl, 3-hydroxy-n-propyl, 2-hydroxyisopropyl and 4-hydroxy-n-butyl, particularly preferably 2-hydroxyethyl or 2-hydroxyisopropyl.

Hydroxy-$C_2$–$C_4$-alkyl-(oxa-$C_2$–$C_4$-alkyl)$_n$ preferably has n from 1 to 4, particularly preferably n=1 or 2, such as 5-hydroxy-3-oxapentyl, 5-hydroxy-3-oxa-2,5-dimethylpentyl, 5-hydroxy-3-oxa-1,4-dimethylpentyl, 5-hydroxy-3-oxa-1,2, 4,5-tetramethylpentyl, 8-hydroxy-3,6-dioxaoctyl.

Amino-$C_2$–$C_{12}$-alkyl is preferably amino-$C_2$–$C_8$-alkyl such as 2-aminoethyl, 3-aminopropyl, 4-aminobutyl, 5-aminopentyl, 6-aminohexyl, 7-aminoheptyl and also 8-aminooctyl, particularly preferably 2-aminoethyl and 6-aminohexyl, very particularly preferably 6-aminohexyl.

Substituted melamines particularly suitable for the invention include the following compounds: 2-hydroxyethylamino-substituted melamines such as 2-(2-hydroxyethylamino)-4,6-diamino-1,3,5-triazine, 2,4-di-(2-hydroxyethylamino)-6-amino-1,3,5-triazine, 2,4,6-tris(2-hydroxyethylamino)-1,3,5-triazine, 2-hydroxyisopropylamino-substituted melamines such as 2-(2-hydroxyisopropylamino)-4,6-diamino-1,3,5-triazine, 2,4-di-(2-hydroxyisopropylamino)-6-amino-1,3,5-triazine, 2,4,6-tris(2-hydroxyisopropylamino)-1,3,5-triazine, 5-hydroxy-3-oxapentylamino-substituted melamines such as 2-(5-hydroxy-3-oxapentylamino)-4,6-diamino-1,3,5-triazine, 2,4,6-tris-(5-hydroxy-3-oxapentylamino)-1,3,5-triazine, 2,4-di(5-hydroxy-3-oxapentylamino)-6-amino;1,3,5-triazine and also 6-aminohexylamino-substituted melamines such as 2-(6-aminohexylamino)-4,6-diamino-1,3,5-triazine, 2,4-di(6-amino-hexylamino)-6-amino-1,3,5-triazine, 2,4,6-tris(6-aminohexylamino)-1,3,5-triazine or mixtures of these compounds, for example a mixture of 10 mol % of 2-(5-hydroxy-3-oxapentylamino)-4,6-diamino-1,3,5-triazine, 50 mol % of 2,4-di(5-hydroxy-3-oxapentylamino)-6-amino-1, 3,5-triazine and 40 mol % of 2,4,6-tris(5-hydroxy-3-oxapentylamino)-1,3,5-triazine.

Suitable phenols (B) are phenols containing one or two hydroxyl groups, such as unsubstituted phenols, phenols substituted by radicals selected from the group consisting of $C_1$–$C_9$-alkyl and hydroxyl, and also $C_1$–$C_4$-alkanes substituted by two or three phenol groups, di(hydroxyphenyl) sulfones or mixtures thereof.

Preferred phenols include phenol, 4-methylphenol, 4-tert-butylphenol, 4-n-octylphenol, 4-n-nonylphenol, pyrocatechol, resorcinol, hydroquinone, 2,2-bis(4-hydroxyphenyl)propane, Bis(4-hydroxyphenyl) sulfone, particularly preferably phenol, resorcinol and 2,2-bis(4-hydroxyphenyl)propane.

Formaldehyde is generally used in the form of an aqueous solution having a concentration of, for example, from 40 to 50% by weight or in the form of compounds which supply formaldehyde in the course of the reaction with (A) and (B), for example in the form of oligomeric or polymeric formaldehyde in solid form, such as paraformaldehyde, 1,3,5-trioxane or 1,3,5,7-tetroxane.

The particularly preferred melamine resin fibers are produced by polycondensing customarily melamine, optionally substituted melamine and optionally phenol together with formaldehyde or formaldehyde-supplying compounds. All the components can be present from the start or they can be reacted a little at a time and gradually while the resulting precondensates are subsequently admixed with further melamine, substituted melamine or phenol.

The polycondensation is generally carried out in a conventional manner (see EP-A-355 760, Houben-Weyl, Vol. 14/2, p. 357 ff).

The reaction temperatures used will generally be within the range from 20 to 150° C., preferably from 40 to 140° C.

The reaction pressure is generally uncritical. The reaction is generally carried out within the range from 100 to 500 kPa, preferably at atmospheric pressure.

The reaction can be carried out with or without a solvent. If aqueous formaldehyde solution is used, typically no solvent is added. If formaldehyde bound in solid form is used, water is customarily used as solvent, the amount used being generally within the range from 5 to 40, preferably from 15 to 20%, by weight, based on the total amount of monomer used.

Furthermore, the polycondensation is generally carried out within a pH range above 7. Preference is given to the pH range from 7.5 to 10.0, particularly preferably from 8 to 9.

In addition, the reaction mixture may include small amounts of customary additives such as alkali metal sulfites, for example sodium metabisulfite and sodium sulfite, alkali metal formates, for example sodium formate, alkali metal citrates, for example sodium citrate, phosphates, polyphosphates, urea, dicyandiamide or cyanamide. They can be added as pure individual compounds or as mixtures with each other, either without a solvent or as aqueous solutions, before, during or after the condensation reaction.

Other modifiers are amines and aminoalcohols such as diethylamine, ethanolamine, diethanolamine or 2-diethylaminoethanol.

Examples of suitable fillers include fibrous or pulverulent inorganic reinforcing agents or fillers such as glass fibers, metal powders, metal salts or silicates, for example kaolin, talc, baryte, quartz or chalk, also pigments and dyes. Emulsifiers used are generally the customary nonionic, anionic or cationic organic compounds with long-chain alkyl radicals.

The polycondensation can be carried out batchwise or continuously, for example in an extruder (see EP-A-355 760), in a conventional manner.

Fibers are produced by generally spinning the melamine resin of the present invention in a conventional manner, for example following addition of a hardener, customarily acids such as formic acid, sulfuric acid or ammonium chloride, at room temperature in a rotospinning apparatus and subsequently completing the curing of the crude fibers in a heated atmosphere, or spinning in a heated atmosphere while at the same time evaporating the water used as solvent and curing the condensate. Such a process is described in detail in DE-A-23 64 091.

If desired, the fibers may have added to them up to 25, preferably up to 10%, by weight of customary fillers, especially those based on silicates, such as mica, dyes, pigments, metal powders and delusterants and then be processed to the corresponding fire-safety blankets and nonwovens.

Fire-safety blankets are customarily manufactured by converting the fibers into yarns in a conventional manner, for example by woollen spinning (Ullmann's Enzyklopädie der Technischen Chemie, 4th edition, Vol. 23, "Textiltechnik"). The yarns preferably have a linear density within the range from 100 to 200, particularly preferably from 140 to 160, tex. The yarns are then generally woven up in a conventional manner to wovens having a basis weight within the range from 70 to 900, preferably from 120 to 500, g/m$^2$.

The fire-safety blankets of this invention can also be produced from fiber web nonwovens. Nonwovens are generally obtainable by processing the fibers on webbers with crosslayers. They preferably have a basis weight within the range from 30 to 600, preferably from 50 to 450, g/m$^2$.

According to the invention, it is also possible to make fire-safety blankets from fiber blends comprising essentially from 4.9 to 95% by weight, preferably from 25 to 90% by weight, particularly preferably from 40 to 75% by weight of melamine resin fibers and from 0 to 90.1% by weight, preferably from 5 to 70% by weight, particularly preferably from 15 to 50% by weight, of flame-proof fibers. In addition, as already mentioned, these fiber blends may include from 4.9 to 95% by weight, preferably from 5 to 50% by weight, in particular from 5 to 45% by weight, of normal-flammable fibers selected from the group consisting of wool, cotton, polyamide fibers, polyester fibers and viscose.

The flame-proof fibers are preferably glass fibers, carbon fibers, flame-proof wool, flame-proof viscose and especially aramid fibers. Aramid fibers are preferably produced by spinning solutions of polycondensation products of iso- or terephthalic acid or derivatives thereof, such as acid chlorides, with para- or meta-phenylenediamine in solvents such as N-methylpyrrolidone, hexamethylphosphoric triamide, concentrated sulfuric acid or customary mixtures thereof. The resulting continuous filament fibers are then customarily cut into staple fibers whose thickness is generally within the range from 5 to 25 $\mu$m. Preferred aramid fibers are those based on an isomeric poly-p-phenyleneterephthalamide.

The fiber blends are processed in a conventional manner, for example on customary fiber-blending apparatus as described in Vliesstoffe, Georg Thieme Verlag. In a preferred embodiment, it is customary to start from staple fibers having a customary length of from 1 to 20 cm. These are generally fed via a conveyor into a stationary-top card and preblended therein. The blending is then generally completed in a roller-top card to obtain a waddinglike web. The resulting waddinglike web is then further processed into yarns or nonwovens.

The wovens or nonwovens are then cut to the desired blanket dimensions, which from experience to date depend only on the intended use. Finally, the edges of the blankets are consolidated, generally by sewing.

Fire-safety blankets comprising a metal coating, whether directly on the fiber or on the finished fabric, are characterized by retarded heat passage therethrough and thus by better heat protection for the objects to be protected.

In a further embodiment, the fibers are admixed with salts, especially silicates, but particularly preferably magnesium aluminum silicates, or foam-developing substances by impregnation, brush coating or similar methods.

According to the invention, the fire-safety blankets are used for extinguishing fires, burning objects and persons.

The fabrics of this invention are further used for manufacturing fire-safety blankets for protecting persons and objects from fire, extinguishants and/or combustion products by covering the persons and objects to be protected with the fire-safety blankets of the invention. In addition, the fire-safety blankets of the invention are suitable for protecting works of art and/or antiques. They are also usable for protecting houses and containers on trucks, trains or ships which contain flammable substances and also road tankers and gas holders, electrical or electronic equipment, such as computers, terminals, control panels.

The fabrics of this invention are also suitable for use as flame-retardant coverings for upholstered seats in automobiles, aircraft, railroad carriages, etc.

One advantage of the fire-safety blankets and nonwovens of this invention is that the fire-safety blankets and nonwovens produced according to the invention do not melt on heating or on direct contact with a fire or flame and thus do not drip, and the blankets and nonwovens therefore also remain shape-stable under the action of heat. A further advantage of the fire-safety blankets of this invention is that they afford effective protection against water and other extinguishants and against combustion products, such as soot.

EXAMPLES

Example 1

A fabric composed of a yarn comprising 60% by weight of melamine resin fibers and 40% by weight of p-aramid fibers and having a basis weight of 220 g/m$^2$ was treated with a commercial fluorocarboxylic acid finish by saturating the fabric with a liquor comprising 30 g/l of Persistol® O (commercial product from BASF) and also 3 g/l of aluminum sulfate and 1 g/l of 60% strength acetic acid. The liquor pickup is 70% by weight. The fabric was then dried at 130° C. to a residual moisture content of from 6 to 8% by weight and then heated at 150° C. for 4 min.

The fabric was tested for hydrophobicity by the AATCC 22 spray test and achieved a rating of 70. As regards oil resistance, an AATCC 118 test rating of 6 was achieved.

Testing of the flame-retarding properties:

The protection afforded by the fabric was tested on the lines of the Assessment of the Ignibility of Upholstered Seating by Smouldering and Flaming Ignition Sources, British Standards BS 582:1990, Section 3, Crib 5 or Crib 7.

To this end, the fabric was stretched onto a block of commercial flexible polyurethane foam without flame retardants (about 95 parts by weight of polyol, 50 parts by weight of methylene diisocyanate, 5 parts by weight of water and catalyst) and exposed to a crib 5 ignition source. The foam did not ignite while the ignition source burned and went out (about 8 to 10 min), nor were there any smouldering or glow effects. The same test was repeated without the fabric of this invention. The polyurethane foam ignited spontaneously and was completely consumed by the flames.

In a further test, the ignition source was extinguished with water after 30 sec. A subsequent examination of the polyurethane foam revealed no traces of water.

Example 2

The test fabric used was a fabric composed of a yarn comprising 60% by weight of melamine resin fibers and 40% by weight of p-aramid fibers. In addition, the fabric was coated on both sides with a polyester film aluminized in a high vacuum. The fabric thus obtained had a basis weight of 725 g/m$^2$.

Test of the fire-retarding effect:

The fabric of this invention was stretched over a block of flexible polyurethane foam as described in Example 1 and then exposed to a crib 7 ignition source. The foam did not ignite even after prolonged exposure to the source of ignition; nor did any smouldering or glow effects occur.

The test was repeated, except that after 60 sec the ignition source was extinguished with foam from a commercial fire extinguisher. The fire-extinguishing foam did not pass through the fabric; the polyurethane foam was not found to contain any traces of the action of fire nor of the subsequent extinguishing measure.

Example 3

A polyurethane foam block was covered with an m-aramid needlefelt having a basis weight of 200 g/m$^2$ as described in Example 1 and then exposed to a crib 7 ignition source. After 30 sec the ignition source was extinguished with water. The needlefelt was wet through, and the foam too showed traces of the water.

We claim:

1. A flame-proof fabric comprising, based on the total weight of the fabric, a) from 4.9 to 95% by weight of melamine resin fibers, b) from 0 to 90.1% by weight of flame-proof fibers selected from the group consisting of aramid fibers, carbon fibers, glass fibers, flame-proof wool and flame-proof viscose, c) from 0 to 20% by weight of fillers, further comprising d) from, 4.9 to 95% by weight of normal-flammable fibers and e) from 0.1 to 20% by weight of at least one heat-, oil-soil- and/or moisture-resistant finish comprising metal coating applied to one or both sides of the fabric, and comprising a water repellent as finish.

2. A fabric as claimed in claim 1, wherein the normal-flammable fibers are selected from the group consisting of wool, cotton, polyamide fibers, polyester fibers and viscose.

3. A fabric as claimed in claim 1, wherein the melamine resin fibers are obtainable by condensation of a mixture including as essential components (A) from 90 to 100 mol % of a mixture consisting essentially of (a) from 30 to 100 mol % of melamine and (b) from 0 to 70 mol % of a substituted melamine of the general formula I (I)

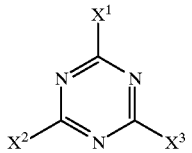

where $X^1$, $X^2$ and $X^3$ are each selected from the group consisting of —$NH_2$, $NHR^1$ and $NR^1R^2$, and $X^1$, $X^2$ and $X^3$ must not all be —$NH_2$, and $R^1$ and $R^2$ are selected from the group consisting of hydroxy-$C_2$–$C_{20}$-alkyl, hydroxy-$C_2$–$C_4$-alkyl-(oxa-$C_2$–$C_4$-alkyl)$_n$, where n is from 1 to 5, and amino-$C_2$–$C_{12}$-alkyl, or mixtures of melamine I, and (B) from 0 to 10 mol %, based on (A) and (B), of phenols which are unsubstituted or substituted by radicals selected from the group consisting of $C_1$–$C_9$-alkyl and hydroxyl, $C_1$–$C_4$-alkanes substituted by two or three phenol groups, di(hydroxyphenyl) sulfones, or mixtures of these phenols, with formaldehyde or formaldehyde-supplying compounds in a molar ratio of melamines to formaldehyde within the range from 1:1.15 to 1:4.5.

4. A fabric as claimed in claim 1, comprising as constituent b) aramid fibers obtainable by polycondensation of iso- or terephthalic acid with a meta- or para-phenylenediamine.

5. Fire-safety blanket or clothing manufactured using a fabric as claimed in claim 1.

6. A method for extinguishing fires and burning objects which comprises covering the fire or burning object with a fire-safety blanket as claimed in claim 5.

7. A method of protecting an object from fire, heat, combustion products and/or extinguishants, which comprises using a fire-safety blanket as claimed in claim 5 to cover the object to be protected.

8. A fabric as claimed in claim 1, wherein the metallic coating comprises aluminum as main constituent.

9. A flame-proof fabric comprising, based on the total weight of the fabric, a) from 4.9 to 95% by weight of melamine resin fibers, b) from 0 to 90.1% by weight of flame-proof fibers selected from the group consisting of aramid fibers, carbon fibers, glass fibers, flame-proof wool and flame-proof viscose, and c) from 0 to 20% by weight of fillers, further comprising d) optionally from, 4.9 to 95% by weight of normal-flammable fibers and e) from 0.1 to 20% by weight of at least one heat-, oil-soil- and/or moisture-resistant finish comprising metal coating applied to one or both sides of the fabric, and comprising a water repellent as finish.

10. A flame-proof fabric comprising, based on the total weight of the fabric, a) from 4.9 to 95% by weight of melamine resin fibers, b) from 0 to 90.1% by weight of flame-proof fibers selected from the group consisting of aramid fibers, carbon fibers, glass fibers, flame-proof wool and flame-proof viscose, and c) from 0 to 20% by weight of fillers, further comprising d) optionally from 4.9 to 95% by weight of normal-flammable fibers and e) from 0.1 to 20% by weight of at least one heat-, oil-, soil- and/or moisture-resistant finish comprising metal coating applied to one or both sides of the fabric, and comprising an oil repellent as finish.

* * * * *

UNITED STATES PATENT AND TRADEMARK OFFICE

CERTIFICATE OF CORRECTION

PATENT NO. : 6,297,178 B1
DATED : October 2, 2001
INVENTOR(S) : Berbner et al.

It is certified that error appears in the above-identified patent and that said Letters Patent is hereby corrected as shown below:

Title page,
Item [30], the Foreign Priority Data, should be:
-- May 2, 1996 (DE) ……. 196 17 634 --

Signed and Sealed this

Second Day of July, 2002

*Attest:*

*Attesting Officer*

JAMES E. ROGAN
*Director of the United States Patent and Trademark Office*